United States Patent [19]

Smith

[11] Patent Number: 4,488,498

[45] Date of Patent: Dec. 18, 1984

[54] APPARATUS FOR PRODUCING DECORATIVELY STITCHED TRIM PART

[75] Inventor: Jack E. Smith, Dayton, Ohio

[73] Assignee: General Motors Corporation, Detroit, Mich.

[21] Appl. No.: 552,408

[22] Filed: Nov. 16, 1983

[51] Int. Cl.[3] ..... D05C 15/00

[52] U.S. Cl. ..... 112/80

[58] Field of Search ..... 112/80, 79 FF

[56] References Cited

U.S. PATENT DOCUMENTS

| | | | |
|---|---|---|---|
| 3,229,653 | 1/1966 | Roberts et al. | 112/80 |
| 3,430,590 | 3/1969 | Looper | 112/80 |
| 3,645,219 | 2/1972 | Jenkins | 112/80 |
| 3,968,758 | 7/1976 | Scholz | 112/80 |
| 4,132,182 | 1/1979 | Heemstra | 112/80 |
| 4,267,784 | 5/1981 | Heemstra | 112/80 |
| 4,366,762 | 1/1983 | Willis | 112/80 |
| 4,388,881 | 6/1983 | Price | 112/80 |

*Primary Examiner*—Ronald Feldbaum

*Attorney, Agent, or Firm*—Patrick M. Griffin

[57] ABSTRACT

A decoratively stitched trim panel is produced by a new apparatus. The trim panel includes a series of decorative stitches of alternating visible and embedded, non-visible loops frictionally retained within the substrate of the trim panel without passing all the way therethrough. The stitching is produced by a method involving the steps of embedding the thread into the substrate with a hollow thread-containing needle, withdrawing the needle up out of the trim part to draw sufficient thread therethrough to make up a visible and half of an embedded loop, indexing the needle forward, re-embedding and withdrawing it again. A stitching machine includes a hand held frame with a pivoted air cylinder having an extendible and retractable arm with a hollow needle thereon. The needle has a slanted tip with a pointed leading edge and a notched trailing edge through which the thread passes. When the cylinder is fired the arm and needle extend until part of the arm begins to engage a cam ramp on the frame just as the tip of the needle begins to pierce the trim part. This engagement with the ramp automatically and repeatably pushes the frame forward the distance of a visible loop, whereupon the cylinder is fired again, and so on.

1 Claim, 16 Drawing Figures

APPARATUS FOR PRODUCING DECORATIVELY STITCHED TRIM PART

This invention relates to decoratively stitched trim parts and a method and apparatus for making such trim parts, and specifically to a trim part having a series of actual decorative stitches on the outer surface thereof and a method and apparatus for providing that stitching.

BACKGROUND OF THE INVENTION

Trim parts, such as foam backed instrument panel pads, often have a simulated decorative stitching molded directly into the vinyl skin or outer layer at the time the resilient foam backing is molded thereto. Actual stitches on the visible outer layer may provide a different aesthetic appearance and color contrast to the trim part. However, it is not practical to actually stitch the outer layer, either manually or on a sewing machine and then mold the foam backing to it, because of difficulties of aligning the stitched layer in the mold, foam leakage through the stitch holes, and the cost of scrapping the part after the most labor intensive step, the stitching, has been completed.

Therefore, the decorative actual stitching should be applied to the completed trim part. This presents several problems in trim parts, such as instrument panels, which are generally irregular in thickness and shape, may have a foam back of convoluted shape, and may have inserts in the foam which make it impossible to pierce the part with a needle, either manually or by sewing machine. Work access is limited only to the outer surface of the outer layer.

It is known to provide actual loop type stitches which extend from the outer side of a material. The material must have generally uniform thickness, be relatively thin, and must be stretched tightly across a frame while being stitched from the inner side. The apparatus includes a hollow needle extending from an enlarged handle and having a central thread passage and a slanted tip with a trailing side and a leading side. The trailing side includes a sharp piercing point and an eye therethrough just above the point. Thread is fed through the central passage with a free end passing out through the eye. As the needle is punched through the material from the inner side, the thread catches on the edge of the hole formed by the needle in the material and additional thread is pulled through the passage and the eye, until the handle engages the inner side of the material. As the needle is pulled back through the material, the eye catches the thread and pulls it back to create a loop having a length half the distance the needle was originally punched through the material. When the needle is pulled back through the material, the tip must be dragged across the inner side of the material without raising it above the surface, for a short distance and then punched through the material to again repeat the process. This process leaves a row of short, flat stitches on the inner or non-visible side of the material and loop type stitches on the outer or visible side. Such a process cannot be used with trim parts such as instrument panels because it requires the complete penetration of the part from the inner side. If the needle is punched only partially through a relatively thick trim part, the thread is pulled back out again by the needle eye when the needle is withdrawn.

SUMMARY OF THE INVENTION

The subject invention solves the above problems and shortcomings of the prior art by providing a trim part having actual decorative stitching on one side thereof and a method and apparatus for providing such decorative stitching.

The actual decorative stitching is formed of a continuous thread arranged in a series of visible loops which are tensioned against the visible outer surface of the outer layer of the trim part. The ends of each visible loop are integral with intermediate loops embedded sufficiently into the resilient foam substrate of the trim part so as to be frictionally retained thereby. The desired aesthetic effect is obtained without regard to the thickness of the trim part, without damage to the trim part, and with access necessary only from the outer or visible side of a completed trim part.

The actual decorative stitching is obtained from a hollow needle having a central thread receiving passage with an open tip or end slanted to produce a piercing leading edge or point and an open notch on the trailing edge. A continuous thread extends through the central passage and out the open end a distance slightly longer than the length of the needle.

Initially, the piercing leading edge of the needle is inserted into the trim part a distance which is called an embedment distance. The needle drags the thread with it since the thread is caught and held relative to the needle in the open notch of the trailing edge. The embedment distance is a distance which is sufficient to frictionally embed the thread into the resilient substrate of the trim part when the needle is withdrawn from the trim part to leave a complete loop embedded in the trim part. The needle is withdrawn above the outer surface of the trim part a distance sufficient to pull thread for the next visible and one half of an embedded loop through the needle. This distance may be called the withdrawn distance and is substantially equal to the combined length of a visible loop and one half the next embedded loop.

Next, the needle is indexed or moved forward along the path to be stitched the length of a visible loop. Then, the needle is reinserted into the trim part for the embedment distance and withdrawn for the withdrawn distance to complete the visible loop and the next embedded loop in the trim part. This process is followed serially to form the desired line of actual stitches. A free thread end extends out from the initial and terminal embedded loops which can be cut off. The needle may be moved by hand or by a machine or apparatus which may be manually or automatically moved along the desired line.

This invention further provides an apparatus which moves or walks along the desired line to be stitched. The apparatus includes a hand held frame having a slotted foot engageable with the outer surface of the trim part and guidably movable along the desired line on the trim part to be stitched. An extendable and retractable mechanism, such as an air cylinder, is pivoted to the frame and has a piston or arm that moves between extended and retracted positions. The above described needle is mounted to the free end of the arm, and a thread source provides thread for the needle. A biasing spring between the frame and the mechanism has sufficient force to rotate the mechanism outwardly of the frame and into engagement with a stop on the frame, to locate the needle to move through the slot in the foot as the arm extends. When the mechanism is actuated to extend the arm, the end of the needle moves below the foot for the embedment distance. When the arm is retracted, the end of the needle moves the withdrawn distance above the foot. The foot includes a camming ramp slanted toward the frame and engageable by the arm as it is extended. This engagement serves to automatically index or move the machine forward during extension of the arm for the distance of a visible loop.

It is therefore an object of the invention to provide on a trim part of the type having a visible outer surface and a thick resilient substrate, decorative stitching comprised of a series of visible loops joined by intermediate loops embedded in and frictionally maintained in place by the resilient substrate.

It is a further object of the invention to provide a method of providing such stitching where access is available only from above the visible outer surface of the trim part.

It is yet another object of the invention to provide an apparatus which automatically moves itself in the pattern of the method described.

BRIEF DESCRIPTION OF THE DRAWINGS

These and other objects of the invention will appear from the following written description and drawings in which.

BRIEF DESCRIPTION OF THE PREFERRED EMBODIMENT

Figure 1:
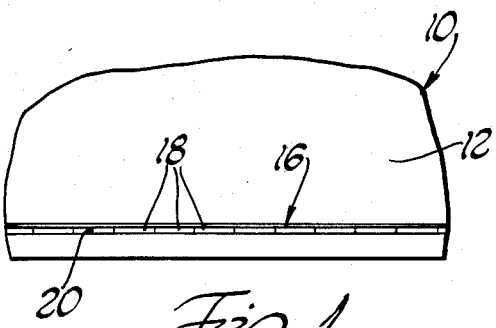
FIG. 1 is a section of a trim part including the decorative stitching of the invention.
Figure 2:
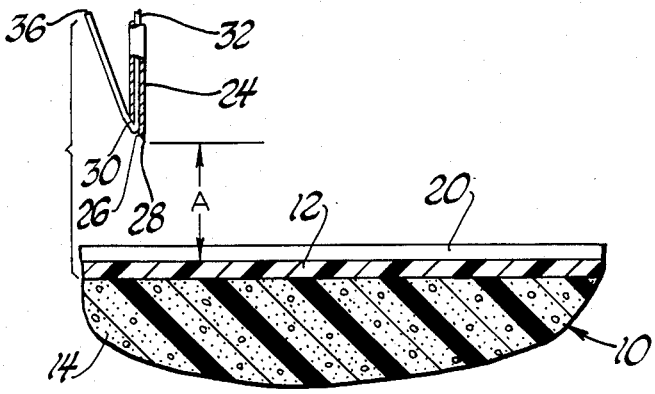
FIGS. 2 through 7 show such a trim part in cross-section and various steps of the method.

Referring first to FIGS. 1 and 2, a trim part designated generally at 10, such as an instrument panel, has a visible outer surface 12 backed by a resilient foam substrate 14. Though only a partial cross-section is shown, resilient foam substrate 14 would, in practice, be thick and irregular, as is normal in instrument panels and may also include various rigid inserts, not shown. The decorative stitching 16 is comprised of a single, continuous thread arranged in a series of visible loops 18 located in a groove 20 and tensioned against the outer surface of layer 12. The loops 18 are held in place by a series of intermediate integral embedded loops 22, one of which may be seen in FIG. 4, which are frictionally held in the resilient substrate 14. Groove 20 is often provided in certain trim parts but is not necessary for the method of this invention. Stitching 16 has the appearance of conventional stitching of the type which passes all the way through a material or which holds two materials together, and yet does not pass all the way through substrate 14. The method of applying stitching 16 is next described.

Referring now to FIGS. 2 through 7, a portion of a movable hollow needle 24 having a central thread receiving passage, FIG. 2, and an open, slanted end 26 providing a leading piercing edge 28 and a trailing edge having a notch 30 is shown. Needle 22 can be moved by any desired apparatus, such as a robot, in any pattern. An apparatus for moving the needle to perform the method will be described last. A continuous thread 32 is supplied from a source through the central thread receiving passage and out through end 26. As shown in FIG. 2, the leading edge of needle 24 is initially located generally perpendicular to the outer surface of layer 12, and a predetermined distance A therefrom, termed the withdrawn distance. The thread 32 is pulled upwardly from the end 26 of the needle so as to be caught in the notch 30 of the trailing edge of the needle.

Figure 3:
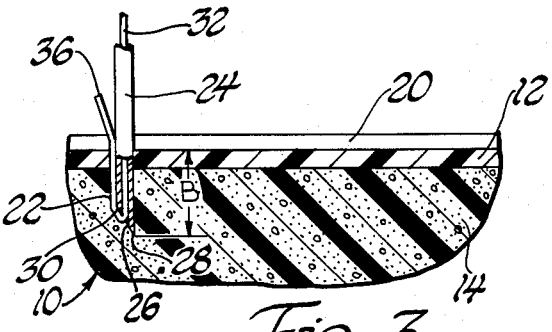

Referring now to FIG. 3, needle 24 is perpendicularly downward so that leading piercing edge 28 pierces layer 12 and moves into resilient substrate 14 a predetermined distance B called the embedment distance. During this movement from the FIG. 2 to the FIG. 3 position, thread 32 has been held by notch 30 so that it cannot move relative to needle 24 and is thereby inserted in substrate 14 for the embedment distance. This distance is sufficient for thread 32 to be frictionally held in substrate 14. This embedment distance will obviously vary depending upon the characteristics of substrate 14 and the thickness or adhering characteristics of thread 32.

Figure 4:
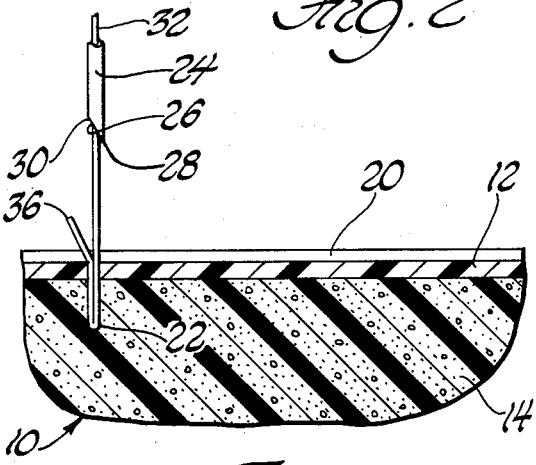

Referring now to FIG. 4, needle 24 is withdrawn from the FIG. 3 position to the FIG. 4 position through the sum of the embedment and withdrawn distances. The FIG. 4 position is the same as the FIG. 2 position. This movement leaves a complete embedded loop 22 of thread 32 in substrate 14. During this movement from the FIG. 3 to the FIG. 4 position, thread 32 moves easily through needle 24 since it is not held by notch 30.

Figure 5:
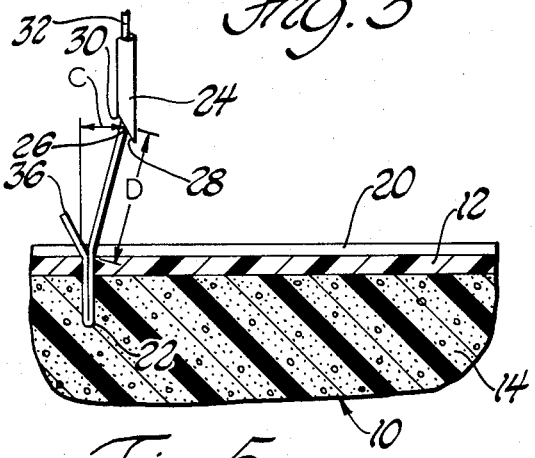
Figure 6:
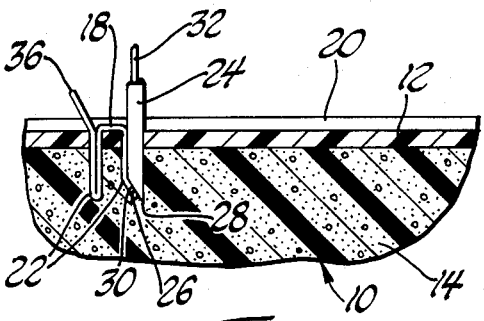

Referring now to FIG. 5, needle 24 is moved or advanced parallel to the groove 20, or any other line desired to be stitched, an advancement distance C equal to the length desired for one visible loop 18. As needle 24 is withdrawn (FIG. 4) and advanced (FIG. 5) a thread length D is determined. A sufficient thread length D must be withdrawn through needle 24 to make up one half of an embedded loop 22 and a visible loop 18. A desired tension for stitch 18 may be obtained by adjusting the withdrawn distance A.

Figure 7:
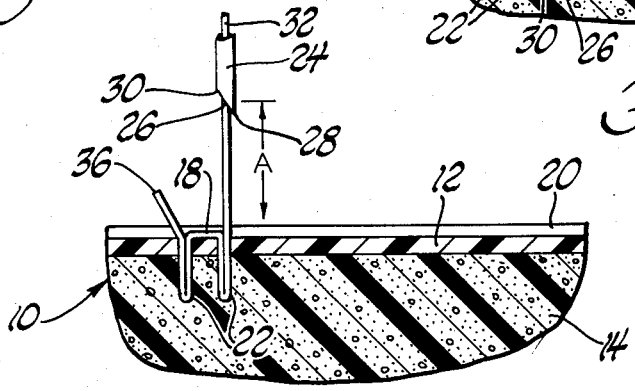

Referring now to FIG. 6, needle 24 has again moved straight back down to its FIG. 3 position. Thread 32 has been embedded in the same manner, leaving, at this point, a visible loop or stitch 18 tensioned above surface 12 along the line defined by groove 20. Visible loop 18 has very little excess thread, and is well tensioned against surface 12. In FIG. 7, needle 24 has been moved its withdrawn distance up to the height of its FIG. 2 position and another embedded loop 22 has been left behind. This process continues to provide the line length desired to be stitched. After that any free end of thread 32, such as 36, may be cut off.

As described above, needle 24 is moved in the desired pattern by any apparatus workable with access only from above surface 12. One such apparatus is a computerized robot programmed to move along the stitch line desired, in the essentially square wave pattern described. However, such apparatus is very expensive and somewhat difficult to program for different patterns quickly. FIGS. 8 through 16 disclose a novel apparatus for carrying out the method. It is a simple, hand held machine movable along any desired line automatically to provide the desired stitch pattern.

Figure 8:
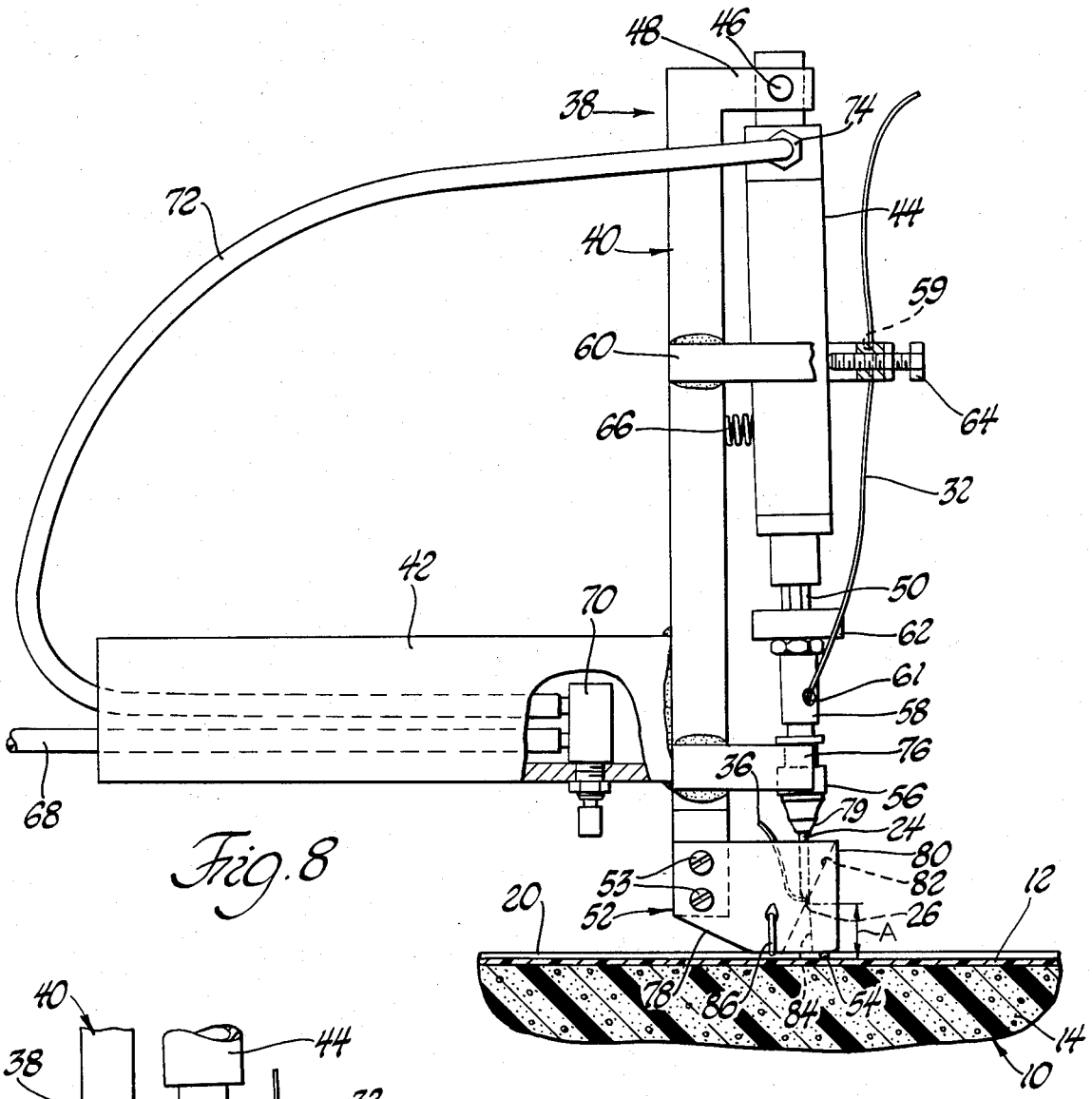
FIGS. 8 through 16 show the apparatus of the invention and the various stages of its operation in carrying out the method.

Referring first to FIG. 8, the stitching machine of the invention is designated generally at 38 and includes a frame designated generally at 40 made of aluminum bar or other suitable material. Needle end 26 is held above surface 12 at the withdrawn distance A of FIG. 2. Frame 40 has a handle 42 welded or otherwise attached thereto which is cylindrical or of any other comfortably hand-held shape. Handle 42 is set near the bottom of frame 40 for stability. A plunger designated generally at 44 is pivoted on pin 46 through the top end thereof to a clevis member 48 at the top of frame 40. Plunger 44 is a conventional single acting air cylinder of the rear pivot type. It has an axial arm 50 which is a non-rotating hexagonal rod with spring retraction. At the bottom end of frame 40 a foot 52 is attached generally perpendicular to the frame by any suitable attachment means such as screws 53. The bottom of foot 52 is engageable with and slidable on surface 12. In the embodiment disclosed, a guiding point 54, best seen in FIG. 16, tracks the groove as the foot moves easily along surface 12. Other details of the foot 52 will be described below.

Referring again to FIG. 8, needle 24 is shown in its entirety. It has a needle base 56 attached to the end of axial arm 50 by a suitable hollow adapter 58. Needle 24 may be a standard medical hypodermic needle. Thread 32 is supplied from any continuous supply means, such as a large coil lying on a table. The thread extends through an aperture 59 in a yoke 60 attached to frame 40, through a hole 61 in adapter 58 and out through needle end 26. An adjustable stop collar 62 is joined to arm 50 just above adapter 58 for a purpose to be described below.

Yoke 60 further includes an adjustable stop screw 64 which is engageable with the barrel of plunger 44. A biasing spring 66 between frame 40 and plunger 44 pushes plunger 44 into stop screw 64. Thus, axial arm 50 and coaxial needle 24 rests at a shallow angle with respect to frame 40, which is perpendicular to surface 12. This angle may be adjusted with the stop screw 64. Biasing spring 66 is relatively weak, just strong enough to pivot plunger 44 about pin 46, for a purpose to be described below.

Plunger 44 is powered by a conventional air supply of approximately 60 psi. Air enters through a feed hose 68 to a conventionaal three way air switch 70 in the handle 42 and out through an extension hose 72 and into the top of plunger 44 through a conventional fitting 74. Each time switch 70 is pushed, arm 50 extends from its fully retracted position of FIG. 8 until stop collar 62 hits a stop clevis 76 attached to frame 40 just above foot 52. Each time switch 70 is released arm 50 will spring retract. It may be seen that needle end 26 will consequently move below the bottom surface of foot 52, and pierce outer surface 12 and substrate 14 to the embedment distance B. Distance B is adjustable by shifting stop collar 62 axially along arm 50. Stitching machine 38 is moved along surface 12 in the pattern of the method by the interaction of needle 24 and foot 52 described next.

Figure 9:
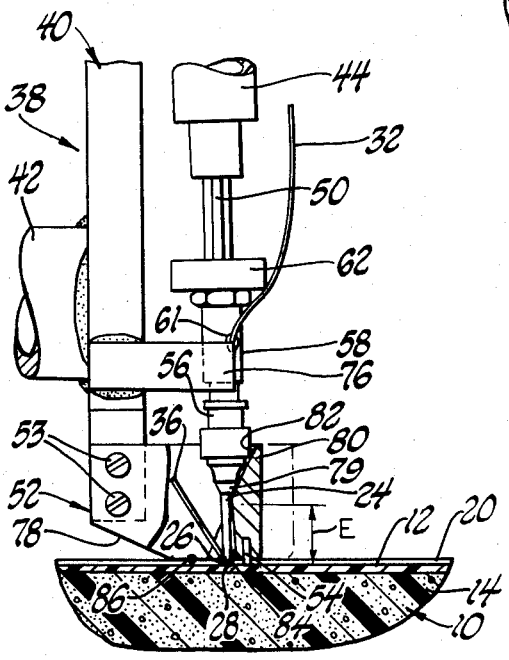
Figure 10:
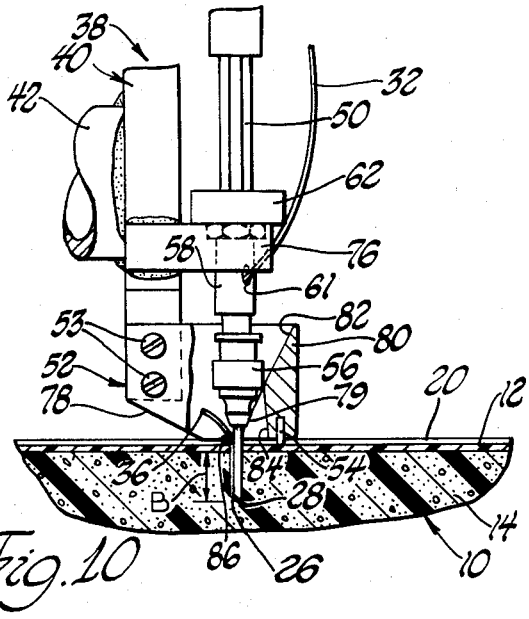
Figure 16:
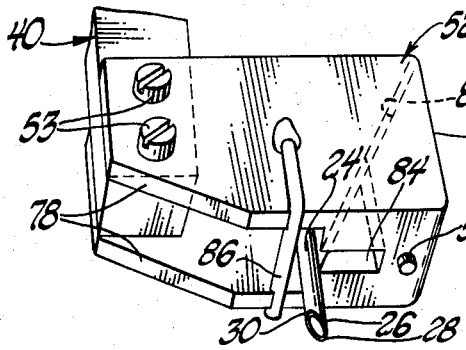

Foot 52, as may be seen in the cross-sections of FIGS. 9 or 10, and in the perspective view of FIG. 16, is generally in the shape of a clevis, having two side walls 78 joined by a relatively thicker front wall 80. The inside of front wall 80 includes a sloped camming ramp 82 which has a clearance slot 84 therethrough, best seen in FIG. 16. In addition, a wire loop 86 traverses side walls 78 across the underside of foot 52, as best seen in FIG. 16, for a purpose to be described below. The needle 24 and camming ramp 82 interaction will now be described with reference to FIGS. 9 through 15.

Referring now to FIG. 9, arm 50 is shown partially extended after switch 70 has been pushed. In this position base 56 of needle 24 has moved down between side walls 78 to a point of engagement 79 where the base just begins to engage camming ramp 82. At this point 79, leading piercing edge 28 of needle 24 has just begun to pierce surface 12. A pierce distance E is thereby established and the needle end 26 is located by the pierced hole in surface 12. Thread 32 has been held in notched trailing edge 30 during needle extension as described previously in the method disclosure.

As arm 50 continues to extend from its position in FIG. 9 to its position in FIG. 10, base 56 slides downwardly along ramp 82 until stop collar 62 hits stop clevis 76. At this point needle end 26 has moved into substrate 14 an embedment distance B. Thus it may be seen that pierce distance E is substantially equal to the embedment distance B or one half an embedded loop 22. Since end 26 of needle 24 is located by the pierced hole in surface 12 (FIG. 9), a further extension of the needle base 56 along camming ramp 82 forces the foot 52 and the frame 40 to which it is attached to move forward or index linearly along groove 20 for the desired length of a visible loop 18. Axial arm 50 and needle 24 are now essentially perpendicular to surface 12. The angle of ramp 82 may be varied to provide the desired frame advance for each extension of the axial needle arm 50.

Figure 11:
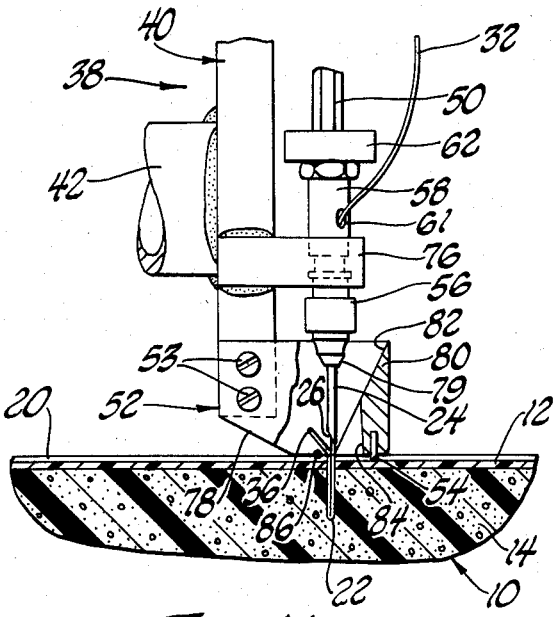
Figure 12:
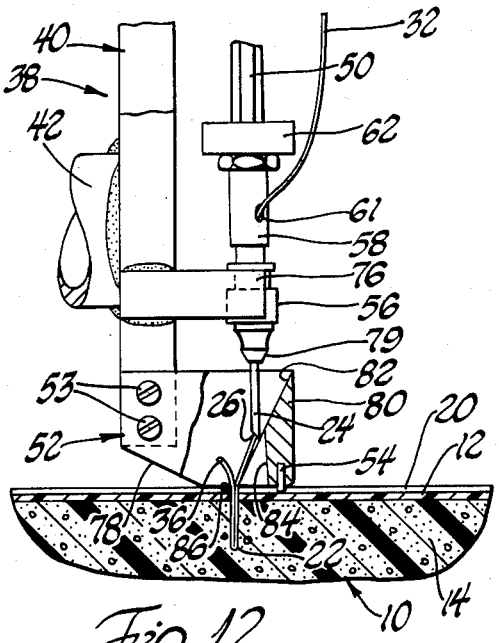

Referring now to FIG. 11, needle 24 has been moved up as arm 50 spring retracted from the FIG. 10 position. Needle end 26 has just exited the hole in surface 12 which had maintained axial arm 50 substantially perpendicular to surface 12 until then. This is because biasing spring 66 is relatively weak compared to the force with which needle 22 is held by the substrate 14 and base 56 is not pushed back into camming ramp 82 to move frame 40 back again as arm 50 retracts. In FIG. 12, needle 22 has moved up its withdrawn distance A and has been rotated by bias spring 66 to the position shown. As will be understood from the previous discussion of the method, an embedded loop 22 has been left in substrate 14, while sufficient thread 34 has been fed through needle 22 to provide the next visible loop 18 and embedded loop 20.

Figure 14:
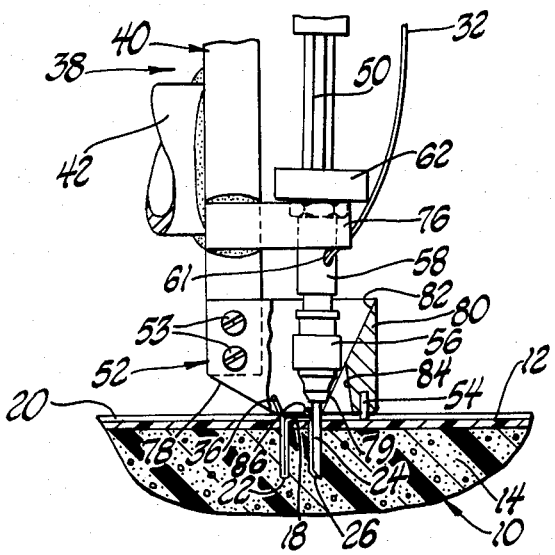

Referring now to FIG. 13, axial arm 50 has again extended to its FIG. 9 position. Leading piercing edge 28 has just begun to pierce surface 12 and base 56 has just begun to engage camming ramp 82. Referring to FIG. 14, needle 24 has moved back to its FIG. 10 position, at full arm 50 extension, and frame 40 has again been indexed forward. Notice that wire loop 86 is now resting upon the just formed visible loop 18. This helps to hold visible loop 18 down during the embedment of the next embedded loop 22.

Figure 15:
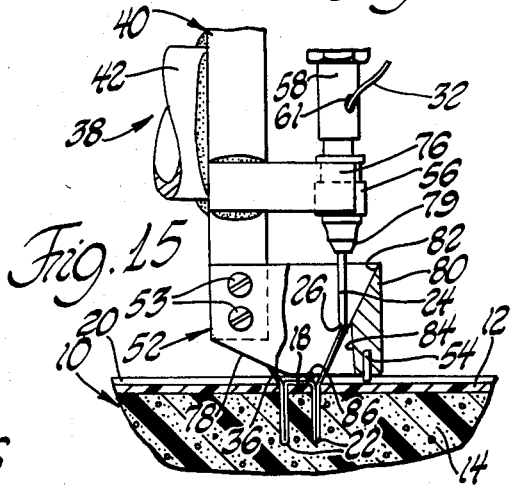

Referring next to FIG. 15, needle 24 has moved back to its FIGS. 8 and 12 position and two embedded loops 22 and a visible loop 18 have been formed. This process is repeated for the distance desired. When stopped, thread 32 may be restarted in the last hole simply by positioning needle 24 over it.

Figure 13:
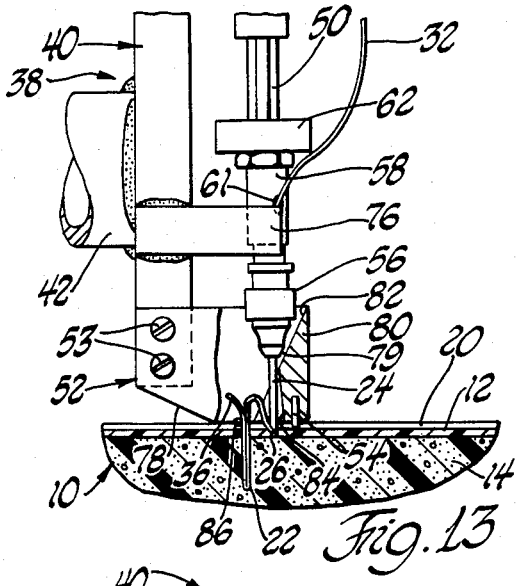

While stitching machine 38 moves automatically, the operator must provide a more or less neutral balance to stitching machine 38 by holding the handle 42 with an even downward pressure so that frame 40 will not kick upward when needle 22 reaches its FIG. 9 or 13 positions. This feel is easily learned through use. In addition, the air may be fed to plunger 44 in a standard pulsed pattern, creating in effect an automatic fire when switch 70 is depressed. It may be seen that stop screw 64 and stop collar 62 are easily adjusted to vary the angle of and depth of extension of arm 50. It will be necessary to provide a different camming ramp 82 to give different indexing movements. For this purpose foot 52 is made removable to facilitate its replacement with a substitute foot having such different camming ramp.

Although the illustrated embodiment thereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. A stitching machine to provide a line of sequential decorative stitches to the visible outer surface of a trim part with access available only to such outer surface, said stitches including a series of visible loops joined by a series of embedded loops, comprising, a frame having a camming ramp portion and a foot portion engageable with the surface for guiding the frame forwardly along the stitch path, an axial arm pivotable on the frame with respect to said camming ramp and reciprocable between extended and retracted positions and supporting a needle end for movement therewith between an initial piercing position at the outer surface of said trim part, an embedment position within the trim part and a withdrawn position outside the trim part, said needle having a thread receiving passage therethrough in communication with an open needle end having a forward piercing edge and a trailing notched edge, thread supply means communicating with said thread receiving passage to provide thread exiting through the open end of the needle, biasing means fixed with respect to said frame and acting to pivot the axial arm forwardly with respect to said camming ramp, stop means fixed with respect to said frame and acting to limit the forward pivoting of the axial arm to a position in alignment with said camming ramp when said axial arm is reciprocated to its retracted position and acting to limit the movement of the needle end to its embedment position when said axial arm is reciprocated to its extended position and acting to limit the distance from said outer surface of the needle end in its withdrawn position when said axial arm is again reciprocated to its retracted position, said axial arm initially engaging said camming ramp as said arm is reciprocated from its retracted position to its extended position as the thread is carried with the needle notched edge and the piercing edge initially pierces the outer surface of said trim part, said axial arm continuing to engage the camming ramp as the arm moves the needle end to its embedment position while the notch edge continues to entrap the thread for movement with the needle end to said embedment position, the camming engagement of said axial arm in cooperation with the needle embedment in said outer surface moving the foot portion of the frame forward an advancement distance along the stitch path equal to the length of a visible loop as said needle end is moved from its initial piercing position to its embedment position to embed said thread, the embedment of said thread in cooperation with said stop means and the reciprocation of said axial arm controlling the amount of thread exiting through the open end of the needle to substantially equal the length of a visible loop and one half of the next embedded loop to provide sufficient thread for one decorative stitch, and means to repeatedly reciprocate said axial arm to provide a series of such decorative stitches.

* * * * *